US007828233B2

(12) United States Patent
Luft

(10) Patent No.: US 7,828,233 B2
(45) **Date of Patent: *Nov. 9, 2010**

(54) FUEL INJECTOR AND METHOD FOR ITS ADJUSTMENT

(75) Inventor: Heinz Luft, Hirschaid (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

This patent is subject to a terminal disclaimer.

(21) Appl. No.: 12/212,402

(22) Filed: Sep. 17, 2008

(65) Prior Publication Data

US 2009/0078796 A1 Mar. 26, 2009

Related U.S. Application Data

(63) Continuation of application No. 10/089,668, filed as application No. PCT/DE01/02705 on Jul. 18, 2001, now Pat. No. 7,429,007.

(30) Foreign Application Priority Data

Aug. 2, 2000 (DE) ..... 100 37 571

(51) Int. Cl.
*F02M 51/00* (2006.01)

(52) U.S. Cl. ..... 239/585.5; 239/585.1; 239/600

(58) Field of Classification Search ... 239/585.1–585.5, 239/600, 900

See application file for complete search history.

(56) References Cited

U.S. PATENT DOCUMENTS

| | | | | |
|---|---|---|---|---|
| 3,731,881 | A * | 5/1973 | Dixon et al. | 239/585.3 |
| 4,339,082 | A | 7/1982 | Radaelli et al. | |
| 5,165,656 | A | 11/1992 | Maier et al. | |
| 5,383,606 | A | 1/1995 | Stegmaier et al. | |
| 5,829,688 | A * | 11/1998 | Rembold et al. | 239/585.1 |
| 6,145,761 | A | 11/2000 | Muller et al. | |
| 6,915,960 | B2 * | 7/2005 | Luft | 239/5 |
| 7,429,007 | B2 * | 9/2008 | Luft | 239/585.5 |

FOREIGN PATENT DOCUMENTS

| | | |
|---|---|---|
| DE | 30 28 742 | 2/1981 |
| DE | 40 23 826 | 1/1992 |
| DE | 40 23 828 | 1/1992 |

(Continued)

OTHER PUBLICATIONS

Patent Abstracts of Japan, vol. 1995, No. 06, (07077126) Jul. 31, 1995.

(Continued)

*Primary Examiner*—Christopher S Kim
(74) *Attorney, Agent, or Firm*—Kenyon & Kenyon LLP

(57) ABSTRACT

A fuel injector for fuel injection systems of internal combustion engines, in particular for direct injection of fuel into the combustion chamber of an engine, including an actuator, a valve needle which is mechanically linked to the actuator and is acted upon by a restoring spring in a closing direction, for actuation of a valve closing body, which together with a valve seat face forms a sealing seat, and including a sleeve which pre-stresses the restoring spring. An adjusting body is situated adjustably in the sleeve so that a fuel amount flowing through the fuel injector per unit of time is a function of the position of the adjusting body in the sleeve.

3 Claims, 5 Drawing Sheets

FOREIGN PATENT DOCUMENTS

| | | |
|---|---|---|
| DE | 41 23 787 | 1/1993 |
| DE | 42 11 723 | 4/1993 |
| DE | 44 31 128 | 3/1996 |
| DE | 195 16 513 | 11/1996 |
| EP | 0 301 381 | 2/1989 |
| JP | 07 077126 | 3/1995 |
| JP | 07 077127 | 3/1995 |
| WO | WO 99/10649 | 3/1999 |
| WO | WO 01/11220 | 2/2001 |

OTHER PUBLICATIONS

Patent Abstracts of Japan, vol. 1995, No. 06, (07077127) Jul. 31, 1995.

* cited by examiner

FUEL INJECTOR AND METHOD FOR ITS ADJUSTMENT

CROSS-REFERENCE TO RELATED APPLICATIONS

The present application is a continuation of U.S. patent application Ser. No. 10/089,668 filed on Aug. 21, 2002 now U.S. Pat. No. 7,429,007, which was a national-phase application based on international application PCT/DE01/02705 filed on Jul. 18, 2001, each of which is expressly incorporated herein in its entirety by reference thereto.

FIELD OF THE INVENTION

The present invention is related to a fuel injector and a method of adjusting a fuel injector.

BACKGROUND INFORMATION

German Published Patent Application No. 40 23 828 discusses a fuel injector and a method of adjusting a fuel injector. To adjust the amount of fuel to be delivered during the opening and closing operation of the electromagnetically operable fuel injector, a magnetically conductive material, e.g., in the form of a powder which alters the magnetic properties of the internal pole is introduced into a blind hole, and thus the magnetic force is varied until the actual measured flow rate of the medium corresponds to the predetermined setpoint flow rate.

Similarly, German Published Patent Application No. 40 23 826 discusses the insertion of an equalizing bolt into a blind hole of an internal pole including a recess on its periphery, inserting it to the extent that the actual measured amount corresponds to the predetermined setpoint amount, and thus varying the magnetic force until this is achieved.

German Patent Published Application No. 195 16 513 also discusses a method of adjusting the dynamic flow rate of a fuel injector. In this case, an adjusting element situated close to the magnetic coil outside the flow path of the medium is adjusted. In doing so, the size of the magnetic flux in the magnetic circuit, and thus the magnetic force, changes, so it is possible to influence and adjust the flow rate. The adjustment may be performed with when the fuel injector is either wet or dry.

German Patent Published Application No. 42 11 723 discusses a fuel injector and a method of adjusting the dynamic flow rate of the medium of a fuel injector, in which an adjusting sleeve including a longitudinal slot is pressed into a longitudinal bore in a connection piece up to a predetermined depth, the dynamic actual flow rate of medium of the injector is measured and compared with a setpoint flow rate of medium, and the pressed-in adjusting sleeve which is under a tension acting radially is advanced until the actual measured flow rate of the medium matches the predetermined setpoint flow rate of the medium.

In German Published Patent Application No. 44 31 128, to adjust the dynamic flow rate of medium of a fuel injector, the valve housing undergoes deformation due to the action of a deformation tool on the outer perimeter of the valve housing. This changes the size of the residual air gap between the core and the armature, and thus the magnetic force, so that it is possible to influence and adjust the flow rate of medium.

One disadvantage of the group of methods which influence the magnetic flux in the magnetic circuit is the great expense with regard to manufacturing costs, because the required static flow tolerances must be guaranteed, although this is difficult to implement. In particular, measurements of magnetic fields are complicated to perform and usually require cost-intensive methods and a test field.

It is believed that a disadvantage of the group of mechanical adjustment methods is the high degree of inaccuracy to which these methods may be subject. Furthermore, the opening and closing times of a fuel injector may be shortened only at the expense of electric power, so that the electric load on the components is increased, and the controllers are under greater stress.

In particular, the method referred to in German Published Patent Application No. 44 31 128, where the residual air gap between the core and the armature is varied by deformation of the valve housing, permits only a very inaccurate correction of the flow rate because shear stresses in the nozzle body may have a negative effect on the direction and size of the deforming force. Therefore, a high manufacturing precision is necessary for all parts.

SUMMARY

The exemplary fuel injector according to the present invention and the exemplary method according to the present invention for adjusting a fuel injector, due to the introduction of an adjusting body into a sleeve which may be pressed into the valve body, may allow the flow rate to be monitored and adjusted in a mechanical manner.

The flow rate may be adjusted after the fuel injector has already been installed. The adjusting body may be accessible from the outside on its end facing the fuel feed and may be displaced as desired in the sleeve and pushed into the aperture plate by an adjustment bolt after measurement of the actual amount.

The configuration of the sleeve including a thread which cooperates with a thread provided on the adjusting body may allow the adjusting body to be securely set in position very well. In addition, the adjusting body may be unscrewed from the sleeve again to replace it.

The aperture plate, whose cross section may be increased or reduced by introducing the adjusting body, may also be used in mass-produced fuel injectors. The adjustment of the adjusting body in the sleeve and the manufacture of the adjusting body, the sleeve and the aperture plate may be accomplished in a simple manner in terms of the manufacturing technology.

The static and dynamic flow rates may be adjusted separately, so that the preset flow rates need not be altered by further adjustments.

Other adjustment features of the fuel injector may not be affected by the adjustment of the flow rate through the sleeve and the adjusting body.

Exemplary embodiments of the present invention are illustrated in the diagrams and are explained in greater detail in the following description.

DETAILED DESCRIPTION

Figure 1:
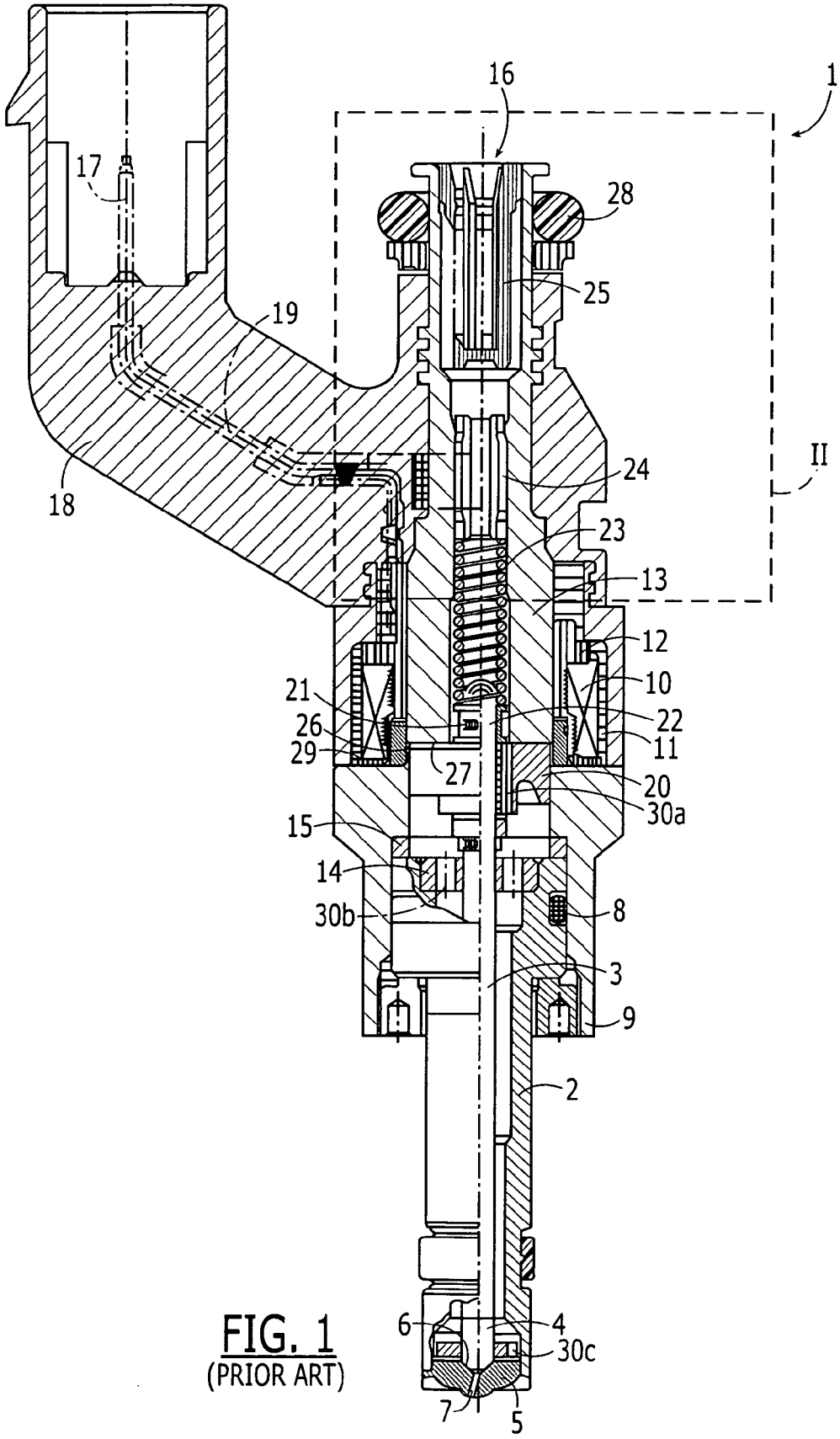
FIG. 1 (PRIOR ART)
FIG. 1 shows a schematic sectional view through an exemplary embodiment of a fuel injector according to the related art.

Before describing three exemplary embodiments of a fuel injector according to the present invention in greater detail on the basis of FIGS. 2 through 5, a known fuel injector of the same design as in the exemplary embodiments, except for the measures according to the present invention, will first be explained briefly with regard to its essential components on the basis of FIG. 1.

Fuel injector 1 may be configured in the form of a fuel injector for fuel injection systems of internal combustion engines having spark ignition of a fuel-air mixture. Fuel injector 1 may be suitable for direct injection of fuel into a combustion chamber of an engine.

Fuel injector 1 may include a nozzle body 2 in which a valve needle 3 may be guided. Valve needle 3 may be mechanically linked to a valve closing body 4 which cooperates with a valve seat face 6 situated on a valve seat body 5 to form a sealing seat. In this exemplary embodiment, fuel injector 1 may be an inwardly opening fuel injector 1 including an injection orifice 7. Nozzle body 2 may be sealed by a seal 8 with respect to stationary pole 9 of a magnetic coil 10. Magnetic coil 10 may be encapsulated in a coil housing 11 and may be wound on a field spool 12 which may be in contact with an internal pole 13 of magnetic coil 10. Internal pole 13 and stationary pole 9 may be separated by a gap 26 and may be supported on a connecting component 29. Magnetic coil 10 may be energized over a line 19 by electric current supplied via an electric plug contact 17. Plug contact 17 may be surrounded by a plastic sheathing 18 which may be integrally molded on internal pole 13.

Valve needle 3 may be guided in a valve needle guide 14 which may be designed in the shape of a disk. A matching adjustment disk 15 may be used to adjust the lift. On the other side of adjustment disk 15 there may be an armature 20 which may be in a friction-locked connection with valve needle 3 via a flange 21, the valve needle being joined to flange 21 by a weld 22. A restoring spring 23 may be supported on flange 21; in the present design of fuel injector 1, the restoring spring may be pre-stressed by a sleeve 24. Fuel channels 30*a* through 30*c*, which carry the fuel that may be supplied through a central fuel feed 16 and filtered through a filter element 25 to injection orifice 7, run in valve needle guide 14, armature 20 and on valve seat body 5. Fuel injector 1 may be sealed by a seal 28 with respect to a receiving bore (not shown), e.g., in a fuel rail.

In the resting state of fuel injector 1, armature 20 may be acted upon by restoring spring 23 against its direction of lift so that valve closing body 4 may be held sealingly on valve seat 6. When magnetic coil 10 is energized, it creates a magnetic field which moves armature 20 in the direction of lift against the elastic force of restoring spring 23, the lift being predetermined by a working gap 27 between internal pole 12 and armature 20 in the resting position. Armature 20 also entrains flange 21, which may be welded to valve needle 3, in the direction of lift. Valve closing body 4, which may be mechanically linked to valve needle 3, may be lifted up from the valve seat face, and fuel may be injected through injection orifice 7.

When the coil current may be turned off, armature 20 drops back from internal pole 13 due to the pressure of restoring spring 23 after the magnetic field has subsided sufficiently, so that flange 21, which may be mechanically linked to valve needle 3, moves against the direction of lift. Valve needle 3 may be thus moved in the same direction, so that valve closing body 4 may be set down on valve seat face 6, and fuel injector 1 may be closed.

Figure 2:
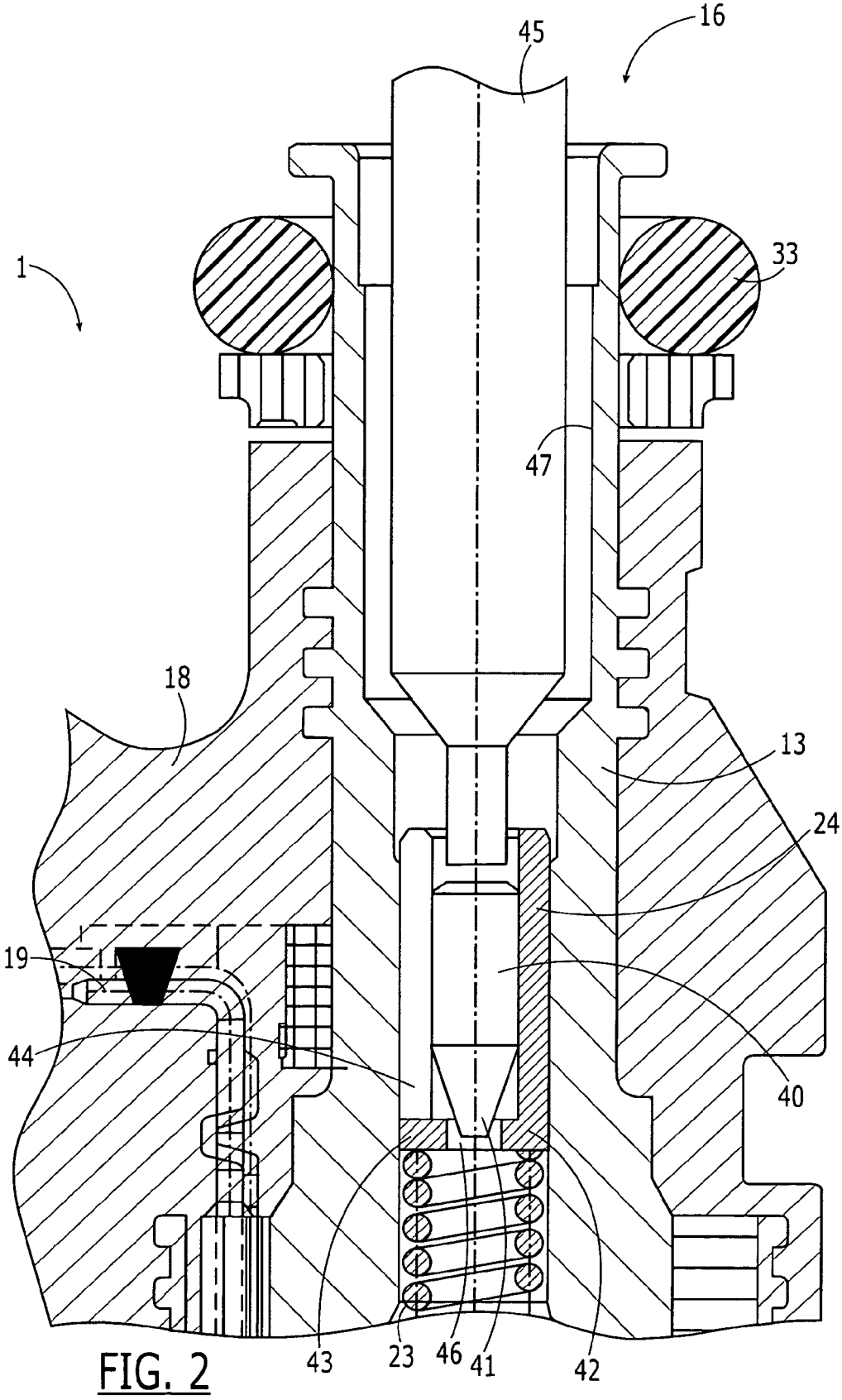
FIG. 2 shows a detail of a schematic section through a first exemplary embodiment of the fuel injector according to the present invention in area II in FIG. 1.

In an excerpt of a sectional diagram, FIG. 2 shows the detail of fuel injector 1 which is labeled as II in FIG. 1.

The first exemplary embodiment of fuel injector 1 according to the present invention illustrated in FIG. 2 shows the inlet-side part of fuel injector 1 without filter element 25, which is present in central fuel feed 16 in FIG. 1. Whereas FIG. 1 shows only sleeve 24, which may be needed for adjusting the dynamic fuel flow which may be influenced by the opening and closing times, the exemplary embodiment illustrated in FIG. 2 also has an adjusting body 40 which may be inserted into sleeve 24 and may be used for adjusting the static fuel flow, i.e., the flow of fuel in the opened static state. Adjusting body 40 has a cylindrical shape in the present exemplary embodiment and may be configured with a taper in the form of a truncated cone on injection end 41. On its injection end 42, sleeve 24 may be closed by an aperture plate 43. Aperture plate 43 and sleeve 24 may be designed in one piece or they may be manufactured as two different parts. In the present exemplary embodiment, sleeve 24 and aperture plate 43 form one overall part. For the sake of facilitating installation, sleeve 24 may include a lateral slot 44 which extends as far as aperture plate 43.

To regulate the static fuel flow, adjusting body 40 may be displaced in sleeve 24 in the injection direction using adjustment bolt 45. Then conical injection end 41 of adjusting body 40 may be pushed into aperture plate 43. The fuel flow through fuel injector 1 decreases depending on how far injection end 41 of adjusting body 40 projects into a borehole 46 in aperture plate 43.

The dynamic fuel flow may be determined by the position of sleeve 24. The further sleeve 24 may be pressed into a central recess 47 in fuel injector 1 by a suitable tool, the greater is the pre-stress acting on restoring spring 23 and the longer it lasts until fuel injector 1 is opened in the opening operation or the faster fuel injector 1 may be closed in the closing operation. This means that the dynamic fuel flow through fuel injector 1 decreases with an increase in the pre-stress on restoring spring 23 or with an increase in the depth of installation of sleeve 24.

If sleeve 24 is introduced into central recess 47 in a certain desired position, the static fuel flow through fuel injector 1 when the latter is open may be adjusted via adjusting body 40. To determine the proper flow rate and the correct position of adjusting body 40 in sleeve 24, first the actual flow through fuel injector 1 may be measured. The actual measured value may then be compared with a predetermined setpoint value of the flow rate. Then adjusting body 40 may be displaced in sleeve 24 in the direction of injection by adjustment bolt 45 until the actual value matches the setpoint value. Since it is no longer possible to remove adjusting body 40 from sleeve 24, to this end fuel injector 1 must have a static flow rate which is greater than the setpoint value before adjusting the static flow rate.

When the setpoint value for the flow rate through fuel injector 1 has been reached, adjustment bolt 45 may be removed and instead filter element 25 may be inserted into central recess 47 of fuel injector 1, as illustrated in FIG. 1.

Figure 3:
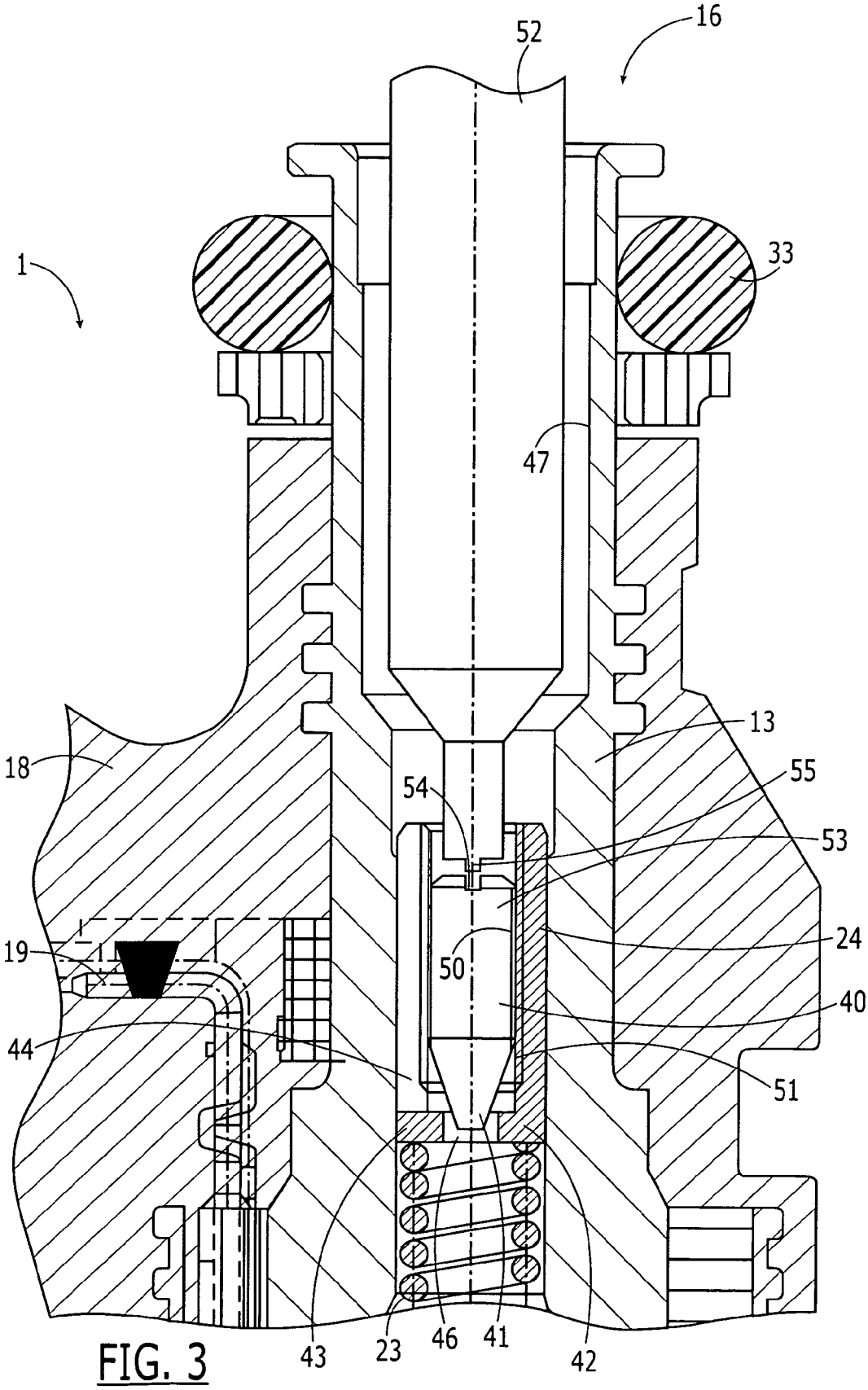
FIG. 3 shows a detail of a schematic section through a second exemplary embodiment of the fuel injector according to the present invention in area II in FIG. 1.

In a detail of a sectional diagram, FIG. 3 shows the detail of a second exemplary embodiment of fuel injector 1 which is labeled as II in FIG. 1.

The second exemplary embodiment of fuel injector 1 according to the present invention differs from the first exemplary embodiment illustrated in FIG. 2 in the design of adjusting body 40 which may be screwed into sleeve 24. To do so, sleeve 24 may be provided with an internal thread 51 and adjusting body 40 may be provided with an external thread 50. Adjusting body 40 is thus no longer pressed into sleeve 24, but instead may be screwed into it by using a suitable adjusting tool 52, e.g., a screwdriver. To this end, an inlet end 53 of adjusting body 40 may include a tool groove 54 in which a corresponding projection 55 on adjusting tool 52 engages.

In this exemplary embodiment of fuel injector 1 according to the present invention, it is not necessary for the actual flow rate of fuel injector 1 at the beginning of the adjustment to be higher than the setpoint flow rate, because adjusting body 40 may be screwed into any desired position in sleeve 24 via external thread 50 and internal thread 51.

Figure 4:
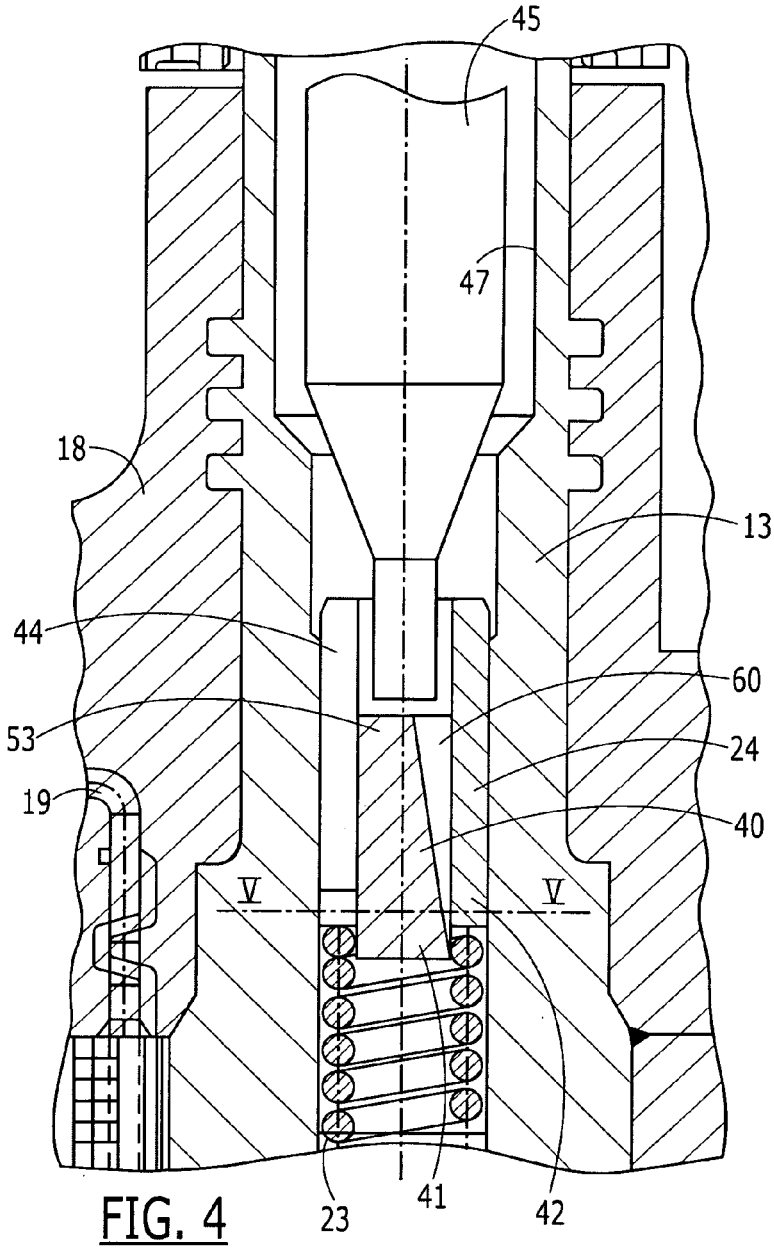
FIG. 4 shows a detail of a schematic section through a third exemplary embodiment of the fuel injector according to the present invention in area II in FIG. 1.

FIG. 4 shows a third exemplary embodiment of fuel injector 1 according to the present invention in the detail labeled as II in FIG. 1.

In the present exemplary embodiment, sleeve 24 does not include an aperture plate 43, but instead may be configured as a hollow cylinder including a side slot 44. Adjusting body 40 may be cylindrical and may include an axial groove 60 on its outer periphery. Groove 60 may have various cross sections and begins on injection end 41 of adjusting body 40, continuing to inlet end 53 of adjusting body 40 as it becomes wider.

The flow rate through fuel injector 1 may be adjusted by a displacement of adjusting body 40 in the direction of injection. In contrast with the exemplary embodiments in FIGS. 2 and 3, where the fuel flow rate through fuel injector 1 decreases with an increase in the depth to which adjusting body 40 may be screwed or pressed into sleeve 24, in the present exemplary embodiment the flow rate increases with an increase in the depth of insertion of adjusting body 40.

When adjusting body 40 is inserted into sleeve 24 and has been pushed in to the extent that injection end 41 of adjusting body 40 and injection end 41 of sleeve 24 are flush with one another, there may be only minimal fuel flow through fuel injector 1 or none at all. The further adjusting body 40 may be pressed through sleeve 24 in the direction of injection, the greater is the wetted cross section made available for flow through groove 60.

With this arrangement the flow rate need not be measured repeatedly and compared with the setpoint value, but instead adjusting body 40 may be pushed continuously further into sleeve 24 until the actual value of flow through fuel injector 1 matches the setpoint value.

Figure 5A:
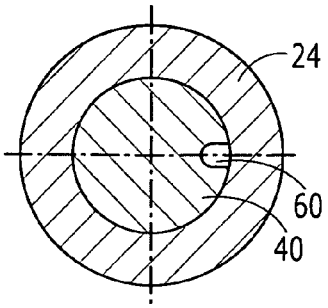
FIG. 5A-C show details of schematic cross sections through the interior part of the third exemplary embodiment of the fuel injector according to the present invention along line V-V in FIG. 4 in various exemplary embodiments.
Figure 5B:
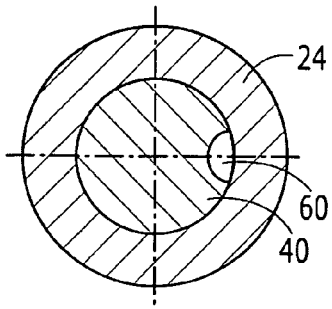
Figure 5C:
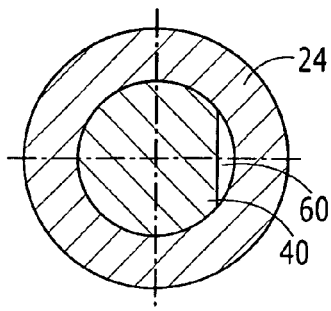

FIGS. 5A-5C show cross sections through injection end 41, 42 of adjusting body 40 and sleeve 24 along line V-V. In adjusting body 40, which fills up sleeve 24, groove 60 may be configured so that fuel flows through it in the direction of the valve seat.

Groove 60 may have various cross sections. In the first exemplary embodiment, which is illustrated in FIG. 5A, groove 60 is U-shaped, while the exemplary embodiment illustrated in FIG. 5B includes a C-shaped groove 60.

The exemplary embodiment illustrated in FIG. 5C, which includes a flattened planar area 60 instead of groove 60, may be simple to manufacture. Adjusting body 40 thus assumes the shape of a notched cylinder.

Figure 6A:
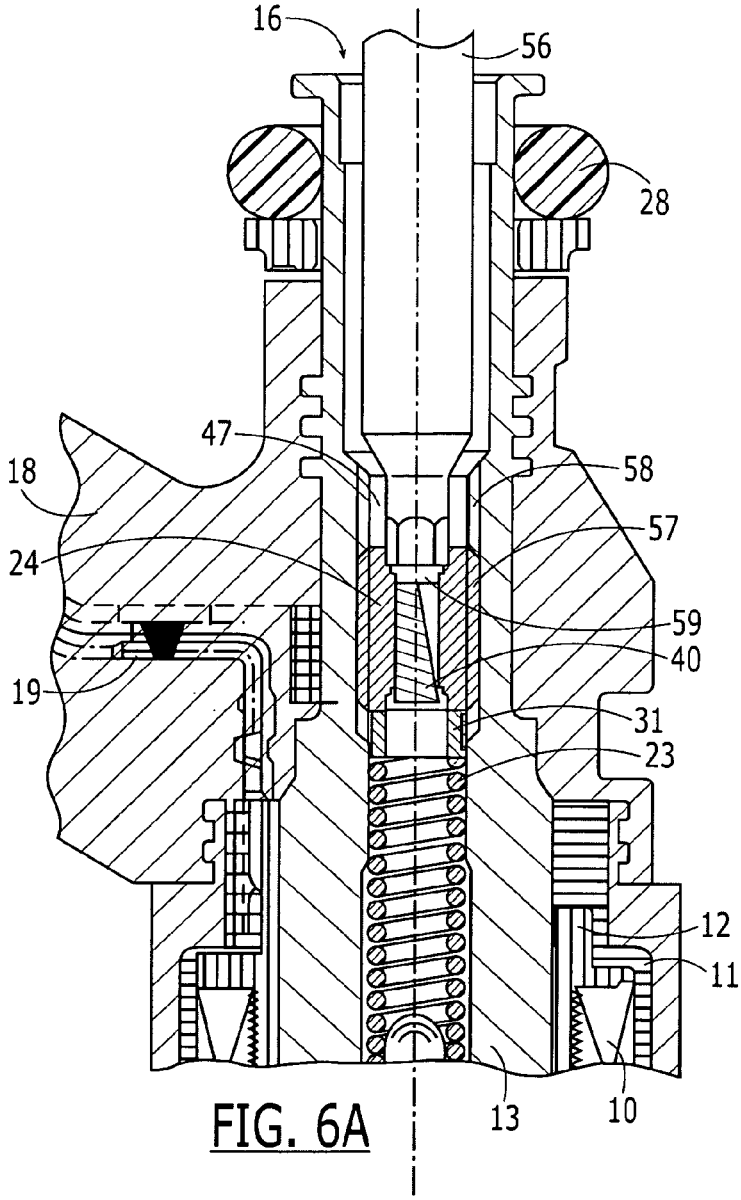
FIG. 6A shows a detail of a schematic section through a fourth exemplary embodiment of the fuel injector according to the present invention in area II in FIG. 1.
Figure 6B:
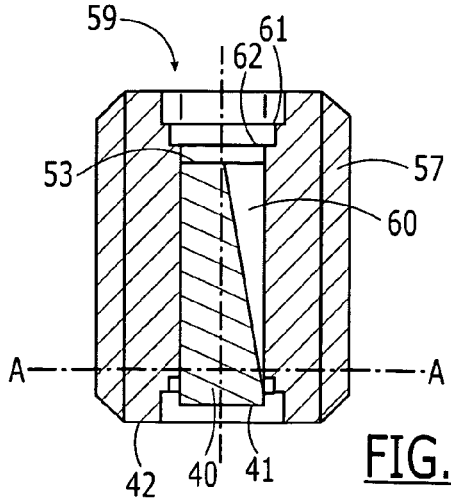
FIG. 6B shows a detailed view of the interior part of the fourth exemplary embodiment of the fuel injector according to the present invention.

FIG. 6A shows a fourth exemplary embodiment of fuel injector 1 according to the present invention. In contrast with preceding exemplary embodiments, sleeve 24 may include an external thread 57 which cooperates with an internal thread 58 of central recess 47 of fuel injector 1. The position of sleeve 24 in central recess 47 of fuel injector 1 may thus be adjusted by turning it by using a suitable adjusting tool 56. The inlet end of sleeve 24 may include a two-step recess 59, the diameter of which tapers in two steps 61 and 62 in the direction of the fuel flow.

In the direction of injection, sleeve 24 may be supported on an intermediate sleeve 31 which may be clamped between sleeve 24 and restoring spring 23. This results in no rotational force being applied to restoring spring 23 when screwing in sleeve 24, thus preventing metal shavings from being removed and also preventing the resulting contamination of fuel injector 1.

The dynamic fuel flow may be defined by the position of sleeve 24, as already explained above. The further sleeve 24 may be screwed into central recess 47 of fuel injector 1 using adjusting tool 56, which may be a hexagon socket wrench, for example, the greater may be the pre-stress acting upon restoring spring 23, and the longer it takes for fuel injector 1 to be opened in the opening operation and the more rapidly fuel injector 1 may be closed in the closing operation. This means that the dynamic fuel flow through fuel injector 1 decreases with an increase in the pre-stress of restoring spring 23 and with an increase in the depth of installation of sleeve 24. Tool 56 then engages in recess 59 in sleeve 24 at the first step 61. The position of adjusting body 40 in sleeve 24 is not affected by screwing in sleeve 24 using adjusting tool 52.

When sleeve 24 is brought into a certain desired position in central recess 47, the static fuel flow which flows through fuel injector 1 when the latter is opened may be adjusted via adjusting body 40. In the present exemplary embodiment this second adjustment step is identical to the method illustrated in FIG. 4. Only stepped recess 59 in sleeve 24 is different, because adjusting body 40 may be displaced by tool 45, which has a smaller diameter than adjusting tool 56. Adjusting tool 45 thus acts on second step 62, without influencing the adjustment of sleeve 24 in recess 47 of fuel injector 1.

Sleeve 24 including external thread 57 may be combined with any desired adjusting body 40, in particular, with adjusting bodies 40 described in conjunction with FIGS. 2 and 3. Thus, for example, an exemplary embodiment may allow the positions of sleeve 24 as well as adjusting body 40 to be varied by turning them by using suitable adjusting tools 56 and 52.

The present invention is not limited to the exemplary embodiments presented here and it may be suitable for any configuration of fuel injectors 1, e.g., for fuel injectors 1 including piezoelectric or magnetostrictive actuators or outwardly opening fuel injectors 1.

What is claimed is:

1. A fuel injector for a fuel injection system of an internal combustion engine, in particular for direct injection of fuel into a combustion chamber of the engine, the fuel injector comprising:

an actuator;

a valve closing body to form a sealing seat with a valve seat face;

a valve needle mechanically linked to the actuator and to be acted upon by a restoring spring in a closing direction, to actuate the valve closing body;

a sleeve to pre-stress the restoring spring; and an adjusting body mounted in direct contact with the sleeve so as to be adjustable so that a fuel amount flowing per unit of time through the fuel injector depends on a position of the adjusting body in the sleeve;

wherein an injection end of the adjusting body is designed with a conical shape;

wherein the sleeve includes an aperture plate arranged on the injection end;

wherein the conical shape of the injection end of the adjusting body projects into a borehole in the aperture plate; and wherein the sleeve is inserted into a central recess in the fuel injector.

2. The fuel injector of claim 1, wherein the position of the adjusting body is variable in the sleeve via a first adjusting tool.

3. A fuel injector for a fuel injection system of an internal combustion engine, in particular for direct injection of fuel into a combustion chamber of the engine, the fuel injector comprising:

an actuator;

a valve closing body to form a sealing seat with a valve seat face;

a valve needle mechanically linked to the actuator and to be acted upon by a restoring spring in a closing direction, to actuate the valve closing body;

a sleeve to pre-stress the restoring spring; and an adjusting body mounted in direct contact with the sleeve so as to be adjustable so that a fuel amount flowing per unit of time through the fuel injector depends on a position of the adjusting body in the sleeve;

wherein an injection end of the adjusting body is designed with a conical shape;

wherein the sleeve includes an aperture plate arranged on the injection end;

wherein the conical shape of the injection end of the adjusting body projects into a borehole in the aperture plate; and wherein the restoring spring is supported on an injection end of the sleeve.

* * * * *